US009540965B2

(12) United States Patent
Hase

(10) Patent No.: US 9,540,965 B2
(45) Date of Patent: Jan. 10, 2017

(54) VALVE TIMING CONTROL DEVICE AND METHOD OF ASSEMBLY THEREOF

(71) Applicant: Hirofumi Hase, Tokyo (JP)

(72) Inventor: Hirofumi Hase, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 50 days.

(21) Appl. No.: 14/427,591

(22) PCT Filed: Nov. 12, 2012

(86) PCT No.: PCT/JP2012/079266

§ 371 (c)(1),
(2) Date: Mar. 11, 2015

(87) PCT Pub. No.: WO2014/073109

PCT Pub. Date: May 15, 2014

(65) Prior Publication Data

US 2015/0247429 A1 Sep. 3, 2015

(51) Int. Cl.

| | |
|---|---|
| ***F01L 1/344*** | (2006.01) |
| ***F01L 1/356*** | (2006.01) |
| ***F01L 1/047*** | (2006.01) |

(52) U.S. Cl.

CPC ..... *F01L 1/356* (2013.01); *F01L 1/047* (2013.01); *F01L 1/3442* (2013.01); *F01L 2001/34456* (2013.01); *F01L 2001/34473* (2013.01); *F01L 2103/00* (2013.01); *F01L 2250/02* (2013.01); *Y10T 29/49247* (2015.01)

(58) Field of Classification Search

CPC ..... F01L 1/3442
USPC ..... 123/90.15–90.18
See application file for complete search history.

(56) References Cited

U.S. PATENT DOCUMENTS

| | | | | |
|---|---|---|---|---|
| 2002/0050257 | A1 | 5/2002 | Watanabe | |
| 2002/0100445 | A1 | 8/2002 | Takenaka et al. | |
| 2011/0120400 | A1* | 5/2011 | Deneri | F01L 1/3442 123/90.15 |

FOREIGN PATENT DOCUMENTS

| | | | |
|---|---|---|---|
| JP | 200-356114 | A | 12/2000 |
| JP | 2002-129917 | A | 5/2002 |
| JP | 2002-295208 | A | 10/2002 |
| JP | 2012-177325 | A | 9/2012 |

* cited by examiner

*Primary Examiner* — Jorge Leon, Jr.
(74) *Attorney, Agent, or Firm* — Birch, Stewart, Kolasch & Birch, LLP

(57) ABSTRACT

A positioning pin 31 is inserted in a pin insertion hole 30 penetrating through a rotor 3 in an axial direction, and has both end portions held by a housing 1 and a cover 12 to prevent falling out thereof. A protrusion 31*a* of the positioning pin 31 protruding toward an inner side of a camshaft fitting recess 3*g* is engaged with a pin engagement groove 110 recessed on an outer circumference surface of an intake side camshaft 100, whereby the rotor 3 and the intake side camshaft 100 are positioned in a rotation direction.

6 Claims, 6 Drawing Sheets

(a)

(b)

VALVE TIMING CONTROL DEVICE AND METHOD OF ASSEMBLY THEREOF

TECHNICAL FIELD

The present invention relates to a valve timing control device that controls an opening/closing timing of an intake valve or an exhaust valve of an engine and a method of assembly of the valve timing control device.

BACKGROUND ART

Conventionally, a variable valve timing control device that controls an opening/closing timing of an intake valve or an exhaust valve has been devised, and in many cases, a vane type hydraulic actuator has been employed therefor. There is provided a configuration in which hydraulic oil distributed to advance and delay sides by an oil control valve is supplied into a valve timing control device through a path in a camshaft. This path has been designed in various configurations, but the following structure is generally known: oil is supplied between a path opened at an end surface of a camshaft and a path opened at a camshaft fitting recess formed in a rotor of the valve timing control device. In the case of such a configuration, the camshaft and the rotor need to be positioned to surely establish a communication between the paths on the camshaft side and the rotor side; conventionally, a positioning pin is press fitted and fixed on the camshaft side or the rotor side, and a distal end of the pin is fitted in a fitting hole on the rotor side or the camshaft side (see, for example, Patent Document 1).

CITATION LIST

Patent Document

Patent Document 1: Japanese Patent Application Laid-open No. 2000-356114

SUMMARY OF THE INVENTION

Problems to be Solved by the Invention

In the conventional one, in order to prevent falling out of the positioning pin in assembling the valve timing control device, the pin needs to be press fitted and fixed. Therefore, there is the following problem: it is required that a hole for press-fitting the pin be manufactured with precision, and press-fitting man hours are also required, so that the cost is increased.

The present invention is made to solve the above-described problem, and an object of the invention is to provide a valve timing control device and a method of assembly thereof that can achieve cost reduction by simply positioning a rotor and a camshaft.

Means for Solving the Problems

A valve timing control device of the present invention includes: a casing that includes a plurality of shoes protruding inward, and forms hydraulic chambers sandwiched between the shoes; a rotor that includes vanes that are accommodated in the casing and divide each of the hydraulic chambers into an advance side and a delay side, a camshaft fitting recess in which one end portion of the camshaft of the engine is fitted, and a pin insertion hole opened in a step portion of the camshaft fitting recess; a positioning pin that is inserted in the pin insertion hole and has a portion of an outer circumference that engages with a pin engagement groove such that the rotor and the camshaft are positioned in a circumference direction, the portion protruding toward an inner side of the camshaft fitting recess, and the pin engagement groove being recessed on an outer circumference surface of the one end portion of the camshaft fitted in the camshaft fitting recess; and a housing that is fixed on a side of the camshaft of the rotor to seal oil in each of the hydraulic chambers and partially closes the opening of the pin insertion hole to prevent the positioning pin from falling out.

In a method of assembly of a valve timing control device of the invention, the device includes: a casing that includes a plurality of shoes protruding inward, and forms hydraulic chambers sandwiched between the shoes; a rotor includes vanes that are accommodated in the casing and divide each of the hydraulic chambers into an advance side and a delay side, a camshaft fitting recess in which one end portion of the camshaft of the engine is fitted, and a pin insertion hole having an opening formed in a step portion of the camshaft fitting recess; a positioning pin that is inserted in the pin insertion hole and has a portion of an outer circumference that engages with a pin engagement groove such that the rotor and the camshaft are positioned in a circumference direction, the portion protruding toward an inner side of the camshaft fitting recess, and the pin engagement groove being recessed on an outer circumference surface of the one end portion of the camshaft fitted in the camshaft fitting recess; a housing that is fixed on a side of the camshaft of the rotor to seal oil in each of the hydraulic chambers and partially closes the opening of the pin insertion hole to prevent the positioning pin from falling out; and a cover that is fixed on an opposite side to the camshaft of the rotor and seals the oil in the hydraulic chambers, and the method includes: coaxially disposing the rotor and the casing with the housing being at a lower position; inserting the positioning pin into the pin insertion hole, penetrating through the rotor in an axial direction, from above to be abutted on the housing on the lower side; disposing the cover over the rotor and the casing to partially close the opening of the pin insertion hole; and fastening the housing, the casing, and the cover to each other with a bolt.

Effect of the Invention

According to the present invention, the positioning pin for positioning the rotor and the camshaft is inserted in the pin insertion hole opened in the step portion of the camshaft fitting recess of the rotor, and is prevented from falling out by the housing; thus, the positioning pin does not need to be press fitted, whereby precision of the pin insertion hole and press-fitting man hours are not required. The pin fitting groove on the side of the camshaft can be formed by molding and the like, whereby the processing cost can be reduced. Thus, there can be provided the valve timing control device in which the rotor and camshaft can be simply positioned to thereby reduce the cost.

According to the invention, the rotor is disposed with the housing placed at a lower position, and the positioning pin is inserted in the pin insertion hole from the upper side of the rotor to be closed with the cover such that the positioning pin is prevented from falling out by the housing and the cover; thus, the positioning pin does not need to be press fitted, whereby precision of the pin insertion hole and press-fitting man hours are not required. Thus, there can be provided the method of assembly in which the rotor and camshaft can be simply positioned to thereby reduce the cost.

BEST MODE FOR CARRYING OUT THE INVENTION

Figure 1:
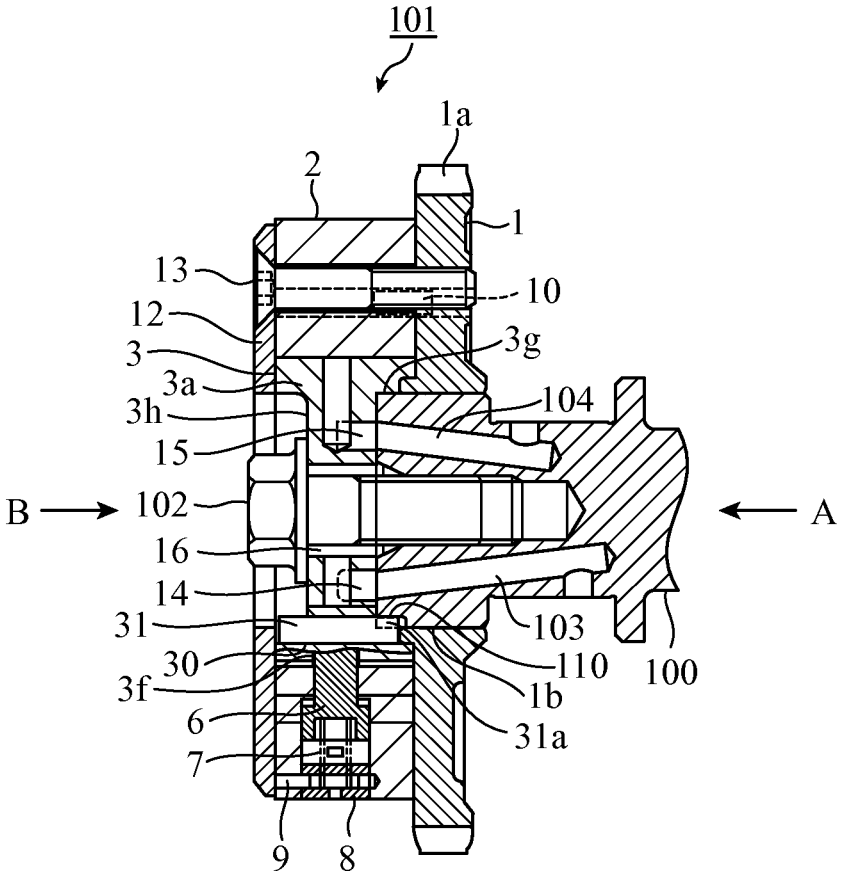
FIG. 1 is a cross-sectional view showing a configuration of a valve timing control device according to Embodiment 1 of the present invention.

In the following, embodiments of the present invention are described in detail by referring to the drawings.

Embodiment 1

Figure 2:
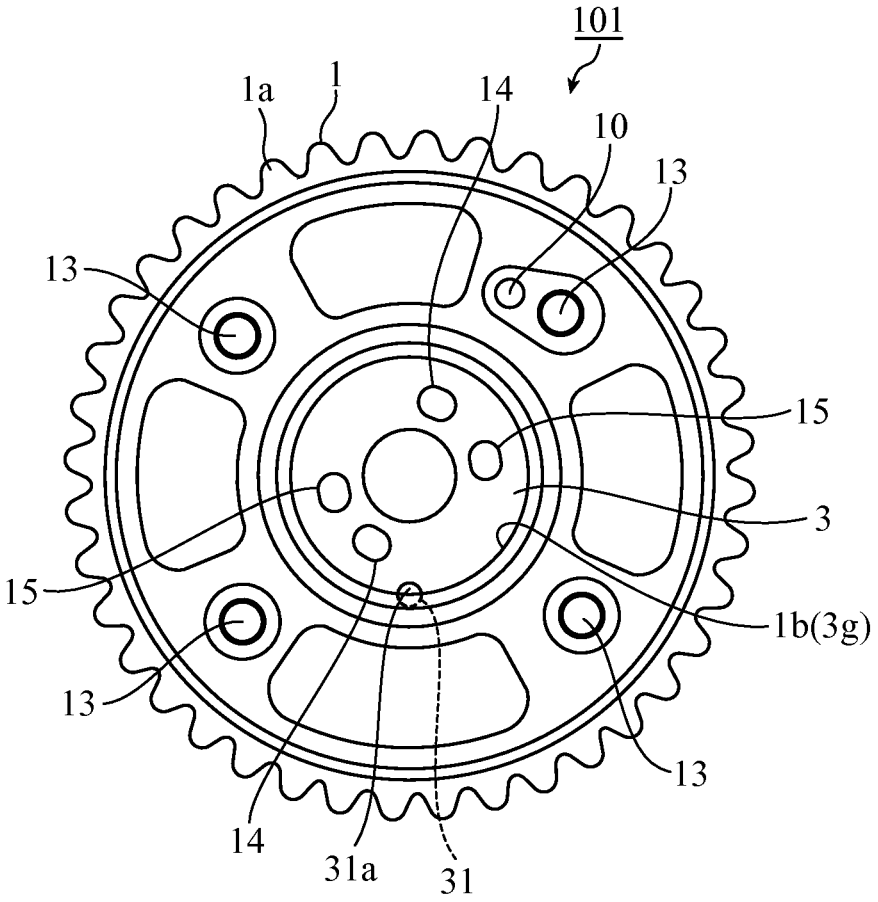
FIG. 2 is a diagram showing the valve timing control device in FIG. 1 as viewed in a direction of an arrow A.
Figure 3:
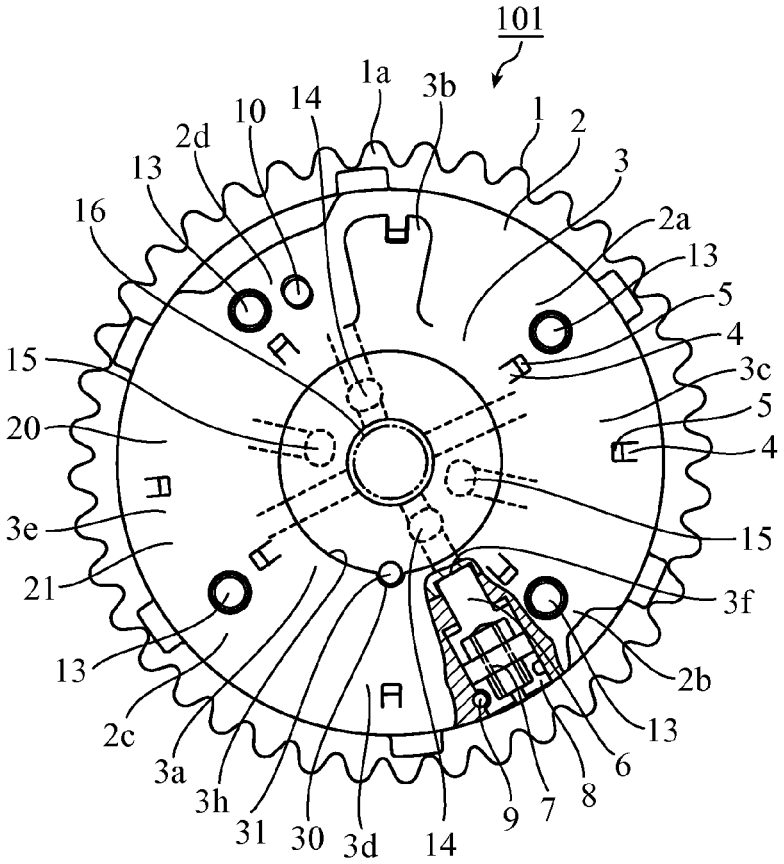
FIG. 3 is a diagram showing the valve timing control device in FIG. 1 with a cover removed as viewed in a direction of an arrow B.
Figure 4:
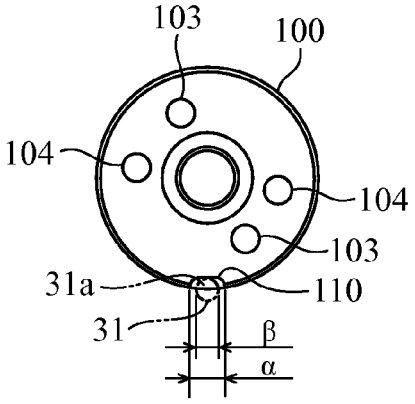
FIG. 4 is a diagram showing an intake side camshaft in FIG. 1 as viewed in the direction of the arrow B.

FIG. 1 is a cross-sectional view showing a configuration of a valve timing control device 101 according to Embodiment 1 of the present invention, and FIG. 2 is a diagram showing the valve timing control device 101 as viewed in a direction of an arrow A. FIG. 3 is a diagram showing the valve timing control device 101 as viewed in a direction of an arrow B with a cover 12 removed. In addition, FIG. 4 is a diagram showing an intake side camshaft 100 as viewed in the direction of the arrow B.

The valve timing control device 101 according to Embodiment 1 of the invention mainly includes a housing 1, a casing 2, a rotor 3, and the cover 12, and is fastened to the intake side camshaft 100 with a bolt 102.

The housing 1 includes a chain sprocket 1*a* that transmits driving force from a crankshaft of an unillustrated engine to the intake side camshaft 100; rotational driving force from the engine is transmitted to the valve timing control device 101 through the chain sprocket 1*a*, so that the rotor 3 and the intake side camshaft 100 are integrally rotated, and thus, the intake side camshaft 100 can be rotated with a predetermined phase difference with respect to the crankshaft.

The casing 2 includes a plurality of shoes 2*a* to 2*d* that protrude from an inner circumference and form a plurality of hydraulic chambers. The rotor 3 is fastened to one end portion of the intake side camshaft 100 with the bolt 102, and includes a plurality of vanes 3*b* to 3*e* that protrude on the outer circumference of a boss 3*a* and divide each of the hydraulic chambers formed through the casing 2 into a delay side hydraulic chamber 20 and an advance side hydraulic chamber 21. Each of the housing 1, the casing 2, and the rotor 3 is formed of ferrous sintered material, and only portions of them that have a sliding function are subjected to machining.

A distal end portion of each of the shoes 2*a* to 2*d* of the casing 2 and the vanes 3*b* to 3*e* of the rotor 3 is formed to have a recessed shape, and a seal member 4 that prevents oil leak between the hydraulic chambers is mounted thereto in each recessed shape in a state where this seal member 4 is pressed by a spring 5.

In addition, a two stage hole penetrating through the shoe 2*b* of the casing 2 in a radial direction is formed, and a plunger 6, a spring 7 that presses the plunger 6 toward the inner side, a stopper 8 that holds the spring 7, and a shaft 9 that fixes the stopper 8 are inserted in the two stage hole. The plunger 6 is configured to be able to slide in the radial direction, and protrude toward the inner circumferential side by the pressing force of the spring 7, and fit in a fitting hole 3*f* formed in an outer circumference surface of the boss 3*a* of the rotor 3, at a predetermined position. When the plunger 6 is fitted in the fitting hole 3*f* of the rotor 3, the rotor 3 can be mechanically restricted so as not to rattle in a state when there is no oil pressure supply, for example, at the time of starting.

The cover 12 covers the casing 2, and seals the oil in the delay side hydraulic chamber 20 and the advance side hydraulic chamber 21. The cover 12, the casing 2, and the housing 1 are fixedly fastened to each other with a plurality of bolts 13. In the example shown in the figure, four places are fastened with the four bolts 13. In addition, holes are formed in respective contact surfaces of the housing 1 and the casing 2, and a pin 10 is inserted in the holes, and thus, the housing 1 and the casing 2 are positioned.

A plurality of advance side oil paths 14 are formed on the inner side of the boss 3*a* of the rotor 3, and each have one opening in communication with the advance side hydraulic chamber 21 and the other opening opened in the bottom surface of a camshaft fitting recess 3*g*. Similarly, a plurality of delay side oil paths 15 are formed on the inner side of the boss 3*a*, and each have one opening in communication with the delay side hydraulic chamber 20 and the other opening opened in the bottom surface of the camshaft fitting recess 3*g*.

On the other hand, in the intake side camshaft 100, a plurality of advance side oil paths 103 and a plurality of delay side oil paths 104 are formed, and each have one opening in communication with an unillustrated oil control valve and the other opening opened in an end surface of the intake side camshaft 100.

The advance side oil path 14 is connected to the advance side oil path 103 opened in the end surface of the intake side camshaft 100, and thus, oil controlled by an unillustrated oil control valve can be supplied to and discharged from the advance side hydraulic chamber 21 through the intake side camshaft 100. Note that paths through which the oil is supplied to the advance side hydraulic chamber 21 includes: a path directly reaching the advance side hydraulic chamber 21 from the advance side oil path 14; and a path reaching the advance side hydraulic chamber 21 from the advance side oil path 14 temporarily via an annular oil path 16 formed by the rotor 3 and the bolt 102.

The delay side oil path 15 can be communicated with the delay side oil path 104 opened in the end surface of the intake side camshaft 100, and thus, the oil controlled by the unillustrated oil control valve can be supplied to and discharged from the delay side hydraulic chamber 20 via the intake side camshaft 100.

In addition, in the rotor 3, a pin insertion hole 30 penetrating through the rotor 3 in the axial direction is formed, and a positioning pin 31 having a column shape is inserted in the pin insertion hole 30. One opening of the pin insertion hole 30 is opened in a step portion of the boss 3*a* on the side of the cover 12, and the other opening is opened in a step portion of the camshaft fitting recess 3*g* on the side of the housing 1. An insertable/extractable size relationship is established between the pin insertion hole 30 and the positioning pin 31, which provides a structure such that both ends of the positioning pin 31 are restricted by the cover 12 and the housing 1 to prevent falling out from the pin insertion hole 30. In the assembled valve timing control device 101, a portion of an outer circumference (protrusion 31*a*) of the positioning pin 31 partially protrudes from a space on the inner diameter side of the camshaft insertion hole 1*b* of the housing 1 into which the intake side camshaft 100 is inserted, and of the camshaft fitting recess 3*g* of the rotor 3 in which one end portion of the intake side camshaft 100 is fitted; the protrusion 31*a* engages with a pin engagement groove 110 formed on an outer circumference surface of the one end portion of the intake side camshaft 100, and thus, the positional relationship between the valve timing control device 101 and the intake side camshaft 100 in the rotation direction (circumference direction) is regulated.

As shown in FIG. 4, the pin engagement groove 110 that engages with the positioning pin 31 is formed on the outer circumference surface of the one end portion of the intake side camshaft 100. The depth of the pin engagement groove 110 in the radial direction is set to be equivalent to the radius of the positioning pin 31, and a groove width a of the pin engagement groove 110 in the circumference direction is set to be larger than a diameter β of the positioning pin 31, whereby a predetermined clearance is formed in the circumference direction. Therefore, the valve timing control device 101 mounted to the intake side camshaft 100 has a predetermined backlash due to the clearance. The advance side oil path 14 and the delay side oil path 15 have predetermined widths in the circumference direction corresponding to the backlash, in such a manner that even when there is the backlash, the oil from the intake side camshaft 100 is surely supplied and discharged, that is, in such a manner that the communication between the delay side oil path 15 of the rotor 3 and the delay side oil path 104 of the intake side camshaft 100 is surely established, and also that the communication between the advance side oil path 14 of the rotor 3 and the advance side oil path 103 of the intake side camshaft 100 is surely established. Thus, the advance side oil path 103 and the delay side oil path 104 of the intake side camshaft 100 have circular openings, whereas the advance side oil path 14 and the delay side oil path 15 of the rotor 3 have elliptical openings.

Figure 5:
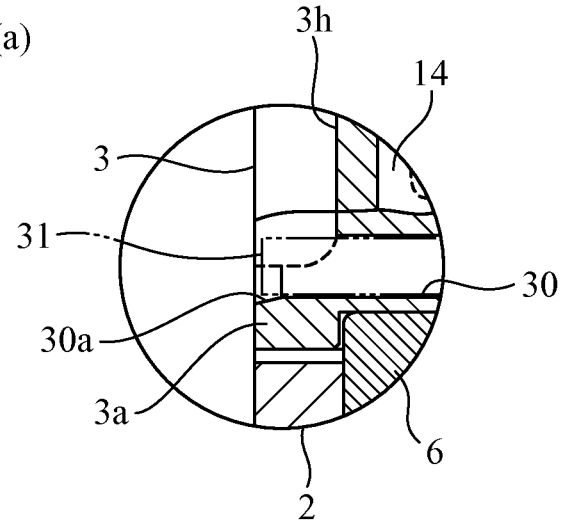
FIG. 5(*a*) and FIG. 5(*b*) are respectively a cross-sectional view and a plan view of an enlarged pin insertion hole of the valve timing control device according to Embodiment 1 of the invention.
Figure 5:
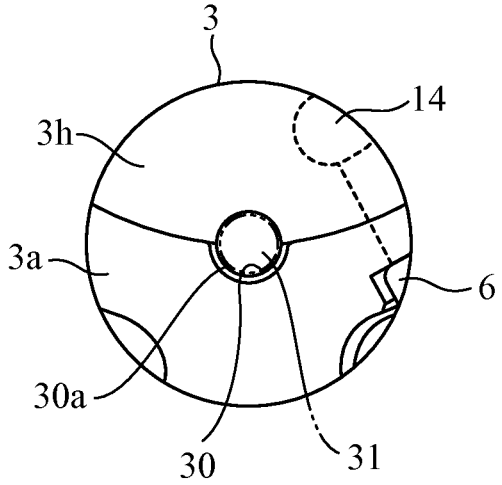

In this connection, FIG. 5(*a*) and FIG. 5(*b*) respectively illustrate a cross-sectional view and a plan view of the enlarged pin insertion hole 30 of the rotor 3. As described later, the positioning pin 31 is inserted therein from the opening of the pin insertion hole 30 on the cover 12 side in Embodiment 1, and thus, a tapered portion 30*a* is formed at a portion related to the boss 3*a* of the opening on the cover 12 side of the pin insertion hole 30, and used as a guide for inserting the positioning pin 31 therein.

Next, a method of assembly of the valve timing control device 101 will be described with reference to FIG. 6.

Figure 6:
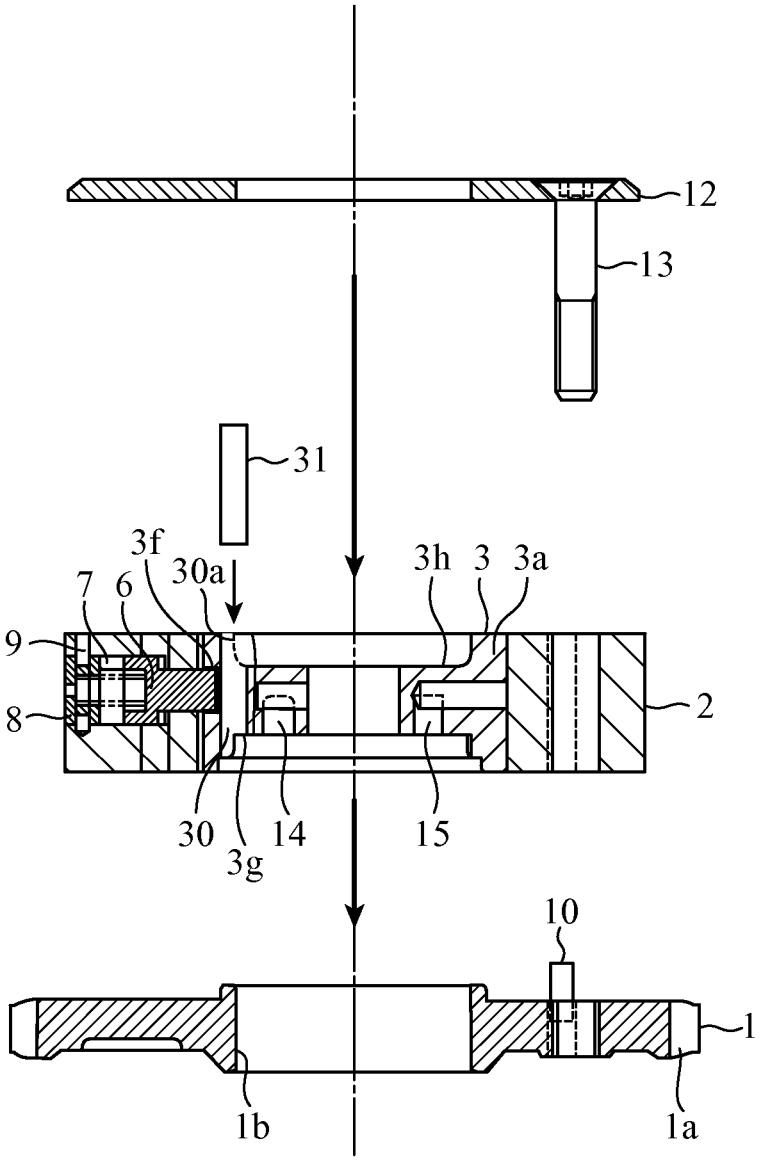
FIG. 6 is a diagram showing a method of assembly of the valve timing control device according to Embodiment 1 of the invention.

In FIG. 6, first of all, the plunger 6, the spring 7, the stopper 8, and the shaft 9 are inserted in the casing 2. Then, the rotor 3 is inserted in the casing 2 at a predetermined position. Then, the housing 1 in which the pin 10 is inserted is placed in a direction shown in FIG. 6, and an assembly of the casing 2 and the rotor 3 as mentioned above is coaxially disposed from the top. At this time, the assembly and the housing 1 are positioned by the pin 10. Subsequently, the positioning pin 31 is inserted in the pin insertion hole 30 from the upper side of the rotor 3 using the tapered portion 30*a* as a guide. The one end portion of the positioning pin 31 is held by abutting on an end surface of the housing 1 disposed below the casing 2. As a final step, the cover 12 is covered, and the bolts 13 are fastened, so that the cover 12, the casing 2, and the housing 1 are fixed. Once the bolts 13 are fastened, the movement of the end portion of the positioning pin 31 is regulated by the cover 12, whereby the positioning pin 31 is held between the housing 1 and the cover 12 so as not to fall out.

At the time of assembling the valve timing control device 101, the positioning pin 31 is inserted in the pin insertion hole 30 penetrating through the rotor 3, whereby no press fitting process is required. Taking into consideration a manual operation for insertion of the positioning pin 31, it is concerned that workability thereof is poor; however, the tapered portion 30*a* is formed at the opening of the pin insertion hole 30, and thus the workability is good. For example, the operability can be improved by setting the length of the positioning pin 31 to ensure about 10 mm for a holding portion in the manual operation, and about 5 mm for an engagement portion for the pin insertion hole 30.

As described above, the positioning pin 31 serving as a unit for positioning the intake side camshaft 100 and the valve timing control device 101 can be disposed on the side of the valve timing control device 101 without using any special equipment and the like. In addition, the pin engagement groove 110 formed on the side of the intake side camshaft 100 can also be formed on the outer circumference side to be thus formed by molding or the like, for example, which allows cost reduction.

The valve timing control device 101 for which the assembly is completed is mounted to the intake side camshaft 100 such that the positioning pin 31 engages with the pin engagement groove 110, and then is fastened and fixed with the bolt 102. In this case, the workability is good because the positioning pin 31 is prevented from falling out.

As described above, in Embodiment 1, the valve timing control device 101 includes: the casing 2 that includes the plurality of shoes 2*a* to 2*d* protruding inward, and forms hydraulic chambers sandwiched between the shoes 2*a* to 2*d*; the rotor 3 that includes the vanes 3*b* to 3*e* that are accommodated in the casing 2 and divide each of the hydraulic chambers into the delay side hydraulic chamber 20 and the advance side hydraulic chamber 21, the camshaft fitting recess 3*g* in which the one end portion of the intake side camshaft 100 is fitted, and the pin insertion hole 30 opened in the step portion of the camshaft fitting recess 3*g*; the positioning pin 31 that is inserted in the pin insertion hole 30, and has a portion (protrusion 31*a*) of the outer circumference that engages with the pin engagement groove 110 such that the rotor 3 and the intake side camshaft 100 are positioned in the circumference direction, the portion protruding toward an inner side of the camshaft fitting recess 3*g*, and the pin engagement groove 110 being recessed on the outer circumference surface of the one end portion of the intake side camshaft 100 to be fitted in the camshaft fitting recess 3*g*; and the housing 1 that is fixed on the side of the intake side camshaft 100 of the rotor 3 to seal the oil in each of the hydraulic chambers and partially closes the opening of the pin insertion hole 30 to prevent the positioning pin 31 from falling out. Therefore, the positioning pin 31 does not need to be press fitted unlike the conventional one, whereby precision of the pin insertion hole 30 and press-fitting man hours are not required. Moreover, the pin engagement groove 110 of the intake side camshaft 100 can be formed by molding or the like to thereby reduce the processing cost. Consequently, the rotor 3 and the intake side camshaft 100 can be simply positioned in the rotation direction, which can provides the valve timing control device 101 that enables the cost reduction.

In addition, according to Embodiment 1, the rotor 3 includes the advance side oil path 14 and the delay side oil path 15 that are opened in the bottom surface of the camshaft fitting recess 3*g*, and are connected to the advance side oil path 103 and the delay side oil path 104 opened in the end surface of the one end portion of the intake side camshaft 100 fitted in the camshaft fitting recess 3*g*; when the groove width α of the pin engagement groove 110 of the intake side camshaft 100 in the circumference direction is larger than the diameter β of the positioning pin 31, the openings of the advance side oil path 14 and the delay side oil path 15 on the side of the rotor 3 each have the elliptic shape elongated in the circumference direction. Therefore, the advance side oil path 14 and the delay side oil path 15 of the rotor 3 have the shape with which the backlash for the positioning can be absorbed with respect to the advance side oil path 103 and the delay side oil path 104 of the intake side camshaft 100. Accordingly, the oil can be surely supplied and discharged even when the positioning by the engagement between the positioning pin 31 and the pin engagement groove 110 involves the backlash.

Further, according to Embodiment 1, the valve timing control device 101 has a configuration to include the cover 12 that is fixed on the opposite side of the intake side camshaft 100 of the rotor 3 and seals the oil in the hydraulic chambers, such that the pin insertion hole 30 is the through hole penetrating through the rotor 3 in the axial direction, and that both end portions of the positioning pin 31 are held by the housing 1 and the cover 12 to prevent the pin from falling out. Therefore, the valve timing control device 101 can stably be mounted to the intake side camshaft 100 with the positioning pin 31 being surely prevented from falling out.

Furthermore, according to Embodiment 1, when assembling the valve timing control device 101, it is configured to coaxially dispose the rotor 3 and the casing 2 with the housing 1 being at a lower position, insert the positioning pin 31 into the pin insertion hole 30 penetrating through the rotor 3 in the axial direction from the top to abut on the housing 1 on the lower side, dispose the cover 12 over the rotor 3 and the casing 2 to partially close the opening of the pin insertion hole 30, and fasten the housing 1, the casing 2, and the cover 12 to each other with the bolt 102. When the positioning pin 31 is prevented from falling out by the housing 1 and the cover 12, there is no need to press fit the positioning pin 31 to thereby improve the workability, and further precision of the pin insertion hole 30 and press-fitting man hours are not required. Thus, the positioning in the rotation direction of the rotor 3 and the intake side camshaft 100*a* can be simply carried out, which can provide a method of assembly thereof that enables the cost reduction.

Additionally, according to Embodiment 1, the pin insertion hole 30 is configured to include the tapered portion 30*a* that guides insertion of the positioning pin 31 at the opening on the cover 12 side. For this reason, the positioning pin 31 can be easily inserted in the pin insertion hole 30, whereby the workability can be further improved.

Embodiment 2

Figure 7:
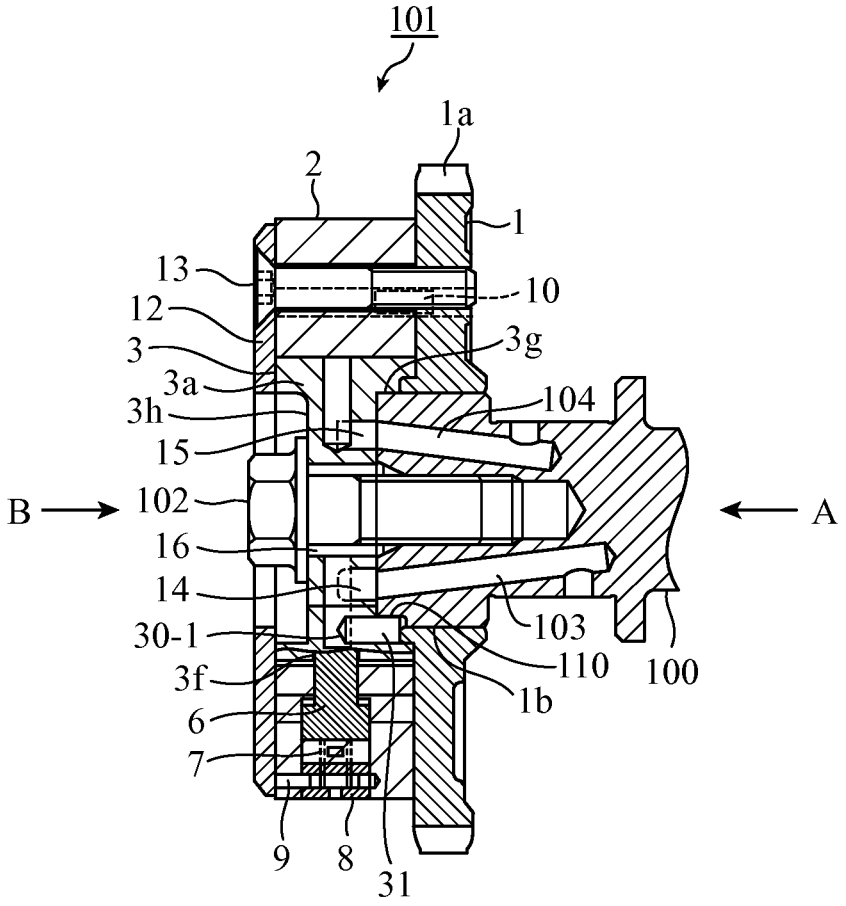
FIG. 7 is a cross-sectional view showing a configuration of a valve timing control device according to Embodiment 2 of the invention.

FIG. 7 is a cross-sectional view of a configuration of a valve timing control device 101 according to the present Embodiment 2. Parts that are the same or similar to those in FIG. 1 are denoted with the same reference numerals, and explanations thereof will be omitted.

Embodiment 1 described above has the configuration in which the pin insertion hole 30 is the through hole penetrating through the rotor 3 in the axial direction, and the positioning pin 31 is inserted therein from the cover 12 side. In this case, the one end portion of the positioning pin 31 abuts on the end surface of the housing 1, and the other end side of the positioning pin 31 protrudes from a recess 3*h* serving as a bearing surface for the bolt 102. Therefore, for example, in a case where the bolt 102 having a size larger than that shown in FIG. 1 is employed, there occurs a limitation in the size of the bearing surface of the bolt 102 due to hindering of the positioning pin 31, for example.

In such a case, as shown in FIG. 7, when a pin insertion hole 30-1 is provided as a bottomed hole not penetrating to the side of the cover 12, and the positioning pin 31 is inserted therein from the side of the housing 1, there is no limitation in the size of the bearing surface for the bolt 102.

Although an illustration is omitted, a tapered portion may be formed at an opening of the pin insertion hole 30-1 on the side of the housing 1 to guide insertion of the positioning pin 31.

As described above, Embodiment 2 provides the configuration in which the pin insertion hole 30-1 is the bottomed hole opened in the step portion of the camshaft fitting recess 3*g* of the rotor 3, and the positioning pin 31 has the both end portions held by the housing 1 and the bottom portion of the bottomed hole to be prevented from falling out. Also with this configuration, the positioning pin 31 can be prevented from falling out, and thus, similarly to Embodiment 1 described above, the positioning pin 31 does not need to be press fitted unlike the conventional one, whereby precision of the pin insertion hole 30-1 and press-fitting man hours are not required. Moreover, the pin engagement groove 110 of the intake side camshaft 100 can be formed by molding or the like to thereby reduce the processing cost. Consequently, the rotor 3 and the intake side camshaft 100 can be simply positioned in the rotation direction, which can provides the valve timing control device 101 that enables the cost reduction.

Incidentally, in Embodiments 1 and 2 described above, the valve timing control device 101 is mounted to the intake side camshaft 100. The same effect as in Embodiments 1 and 2 can be obtained also in a case where the valve timing control device 101 is mounted to a discharge side camshaft.

Other than the above, unlimited combination of the respective embodiments, modification of any configuration element in the embodiments and omission of any configuration element in the embodiments may be made in the present invention without departing from the scope of the invention.

INDUSTRIAL APPLICABILITY

As described above, since the valve timing control device according to the present invention has the rotor and the camshaft positioned by insertion of the positioning pin, it is suitable for use in, for example, a variable valve timing control device applied to a vane type hydraulic actuator.

DESCRIPTION OF REFERENCE NUMERALS AND SIGNS

1: housing, 1*a*: chain sprocket, 1*b*: camshaft insertion hole, 2: casing, 2*a* to 2*d*: shoe, 3: rotor, 3*a*: boss, 3*b* to 3*e*:

vane, 3*f*: fitting hole, 3*g*: camshaft fitting recess, 3*h*: recess, 4: seal member, 5: spring, 6: plunger, 7: spring, 8: stopper, 9: shaft, 10: pin, 12: cover, 13: bolt, 14: advance side oil path (rotor side oil path), 15: delay side oil path (rotor side oil path), 16: annular oil path, 20: delay side hydraulic chamber, 21: advance side hydraulic chamber, 30, 30-1: pin insertion hole, 30*a*: tapered portion, 31: positioning pin, 31*a*: protrusion, 100: intake side camshaft, 101: valve timing control device, 102: bolt, 103: advance side oil path (camshaft side oil path), 104: delay side oil path (camshaft side oil path), 110: pin engagement groove.

The invention claimed is:

1. A valve timing control device that is mounted in an internal-combustion engine and capable of changing an opening/closing timing of an intake valve or an exhaust valve, the valve timing control device comprising:

a casing that includes a plurality of shoes protruding inward, and forms hydraulic chambers sandwiched between the shoes;

a rotor that includes vanes that are accommodated in the casing and divides each of the hydraulic chambers into an advance side and a delay side, a camshaft fitting recess in which one end portion of the camshaft of the engine is fitted, and a pin insertion hole opened in a step portion of the camshaft fitting recess:

a positioning pin that is inserted in the pin insertion hole, and has a portion of an outer circumference that engages with a pin engagement groove such that the rotor and the camshaft are positioned, in a circumference direction, the portion protruding toward an inner side of the camshaft fitting recess, and the pin engagement groove being recessed on an outer circumference surface of the one end portion of the camshaft fitted in the camshaft fitting recess; and a housing that is fixed on a rotor side of the camshaft to seal oil in each of the hydraulic chambers and partially closes the opening of the pin insertion hole to prevent the positioning pin from falling out.

2. The valve timing control device according to claim 1, wherein the rotor includes a rotor side oil path that is opened in a bottom surface of the camshaft Piling recess, and is connected to a camshaft side oil path opened in an end surface of the one end portion of the camshaft fitted in the camshaft fitting recess, and when a width of the pin engagement groove of the camshaft in the circumference direction is larger than a diameter of the positioning pin, the opening of the rotor side oil path has an elliptic shape elongated in the circumference direction.

3. The valve timing control device according to claim 1, further comprising a cover that is fixed on an opposite side to the camshaft of the rotor and seals the oil in the hydraulic chambers, wherein the pin insertion hole is a through hole penetrating through the rotor in an axial direction, and the positioning pin has both end portions held by the housing and the cover to prevent the falling out.

4. The valve timing control device according to claim 1, wherein the pin insertion hole is a bottomed hole opened in the step portion of the camshaft fitting recess of the rotor, and the positioning pin has both end portions held by the housing and a bottom portion of the bottomed hole to prevent the falling out.

5. The valve timing control device according to claim 1, wherein the opening of the pin insertion hole includes a tapered portion that guides insertion of the positioning pin.

6. A method of assembly of a valve timing control device including;

a casing that includes a plurality of shoes protruding inward, and forms hydraulic chambers sandwiched between the shoes;

a rotor that includes vanes that are accommodated in the casing and divide each of the hydraulic chambers into an advance side and a delay side, a camshaft fitting recess in which one end portion of the camshaft of an engine is fitted, and a pin insertion hole opened in a step portion of the camshaft fitting recess;

a positioning pin that is inserted in the pin insertion hole and has a portion of an outer circumference that engages with a pin engagement groove such that the rotor and the camshaft are positioned in a circumference direction, the portion protruding toward an inner side of the camshaft fitting recess, and the pin engagement groove being recessed on an outer circumference surface of the one end portion of the camshaft fitted in the camshaft recess;

a housing that is fixed on a rotor side of the camshaft to seal oil in each of the hydraulic chambers and partially closes the opening of the pin insertion hole to prevent the positioning pin from falling out; and a cover that is fixed on an opposite side to the camshaft of the rotor and seals the oil in the hydraulic chambers, the method comprising:

coaxially disposing, the rotor and the casing with the housing being at a lower position;

inserting the positioning pin into the pin insertion hole, thereby penetrating through the rotor in an axial direction, from an upper side to be abutted on the housing on the lower side;

disposing the cover over the rotor and the casing to partially close the opening of the pin insertion hole; and fastening the housing, the casing, and the cover to each other with a bolt.

* * * * *